United States Patent [19]

Kaarlela

[11] 4,116,688

[45] Sep. 26, 1978

[54] ALLOY AND STRUCTURES MADE THEREFROM

[75] Inventor: William Thomas Kaarlela, Fort Worth, Tex.

[73] Assignee: General Dynamics Corporation, Fort Worth, Tex.

[21] Appl. No.: 643,992

[22] Filed: Dec. 24, 1975

[51] Int. Cl.[2] ..... C22C 1/09

[52] U.S. Cl. ..... 75/229; 29/419 R; 75/154; 75/164; 75/200; 75/201; 75/247; 228/121; 428/539.5; 428/549; 428/568; 428/605

[58] Field of Search ..... 29/182.2, 182.3, 419 R; 75/200, DIG. 1, 154, 164, 229, 201, 247; 228/121; 428/539.5, 549, 568, 605

[56] References Cited

U.S. PATENT DOCUMENTS

| | | | |
|---|---|---|---|
| 2,828,197 | 3/1958 | Blackmer | 428/568 |
| 3,017,268 | 1/1962 | Saarivirta | 75/164 X |
| 3,203,775 | 8/1965 | Cantrell et al. | 75/247 X |
| 3,305,324 | 2/1967 | Krock et al. | 75/247 X |
| 3,668,748 | 6/1972 | Divecha et al. | 29/419 |
| 3,691,623 | 9/1972 | Staudhammer et al. | 29/419 X |
| 3,889,348 | 6/1975 | Lemelson | 75/229 X |
| 3,902,864 | 9/1975 | Nix et al. | 428/539.5 X |
| 3,994,722 | 11/1976 | Kaarlela et al. | 75/DIG. 1 X |
| 4,009,027 | 2/1977 | Naidich et al. | 75/154 |

OTHER PUBLICATIONS

Davis et al. "Metal and Ceramic Matrix Composites" pp. 75–79, Cahner Pub. Co. 1970.

*Primary Examiner*—Richard E. Schafer
*Attorney, Agent, or Firm*—Charles E. Schurman

[57] ABSTRACT

Method and material for fabricating composite structures and cutting tools containing super hard filaments using a modified brazing process that employs liquid phase sintering to alloy a mixture of metals about groups of the filaments in side by side parallelized arrangement to produce preforms or bundles of the filaments secured spaced apart in a strong tough metal matrix. A plurality of the completed bundles may then be bonded together by like method and materials into larger structures, tools or cutting portions thereof.

2 Claims, 2 Drawing Figures

ALLOY AND STRUCTURES MADE THEREFROM

BACKGROUND OF THE INVENTION

The present invention relates to methods and material for facilitating the handling of a plurality of high hardness fibers of the boron filament type by aggregating a plurality of them as groups or fascicles of filaments in an alloy metal matrix to form nuggets, continuous tapes or similar bundles of filaments fixed therein as a solid unit or preform. A plurality of such units then may be easily handled and aggregated and bonded together into larger shapes or forms to produce completed composite structures, e.g., cutting tools.

The boron filaments referred to herein are thin fibers or filaments of substantially elemental boron usually produced by vapor deposition of the boron on a core of fine tungsten wire. The wire acts as a substrate for depositing or growth of the boron as a filament or fiber having a crystallographic internal structure. The filaments are characterized by the ability to wear or fracture along their crystal or lattice fracture planes such that each filament always presents a sharp edge at the tip end being thus useful for cutting or abrading of materials if properly supported. The filaments are also characterized by high tensile strength but have low ductility and tend to break under shearing impact where adequate side support is lacking. As used herein "cutting" is intended as inclusive of cutting, abrading, grinding, polishing, shearing, honing, or the like operations.

Heretofore a number of methods and materials have been proposed for fabricating boron-filament containing matrices for structural or cutting tool use. Such prior methods have often required the filaments to be aggregated together in the matrix material by slow, tedious placement and arrangement of the individual short lengths of filaments in the form and volume finally desired in the final structure. They are then bonded by application of powder metallurgy, casting or hot pressing techniques into the finished product. Several disadvantages proceed from the prior methods which require generally individual handling of all the filaments in order to make final assembly of usable structure. These include slow production, high unit cost leading to requirement for complicated equipment, and the difficulty in obtaining a high volume percentage of the filaments in the matrices used to bond them together. Also maximum handling of a large number of the individual sharp filaments is a safety hazard in that they may stick to or penetrate the skin of personnel so handling them. A good-wearing metal matrix material that can be alloyed about the filaments without degrading their cutting qualities has also been sought for supporting the filaments in a solid mass to produce good tools and structures.

SUMMARY OF THE INVENTION

The present invention provides method and material for combining a series or pack of the filaments together in a safe, readily handleable solid unit or preform containing a plurality of the filaments so as to reduce costs, hazard to personnel and provide for mass production means to be used preliminary to final assembly of completed structures or tools made from the preforms. According to the invention a number of difficulties present in the prior art methods and materials have been found significantly overcome when a series of the filaments in strands of long lengths or shorter "chopped" lengths are coated with a metals mixture consisting essentially of copper, tin and titanium and then heated and liquid phase sintered to bond the filaments sheaved together in the resulting metal alloy matrix as relatively small groups, or unitized bundles of the filaments. A plurality of these subsequently may be coated with a like metals mixture, and heated and liquid phase sintered to bond them into the desired larger completed composite structural articles, tools or portions thereof. When processed in accordance with the present invention the metals mixture or composition provides a strong, wear resistant matrix solidly holding the filaments with the needed side support and having the toughness, with resistance to impact and compression forces, necessary for the resulting filament/matrix composite to be successfully used for numerous cutting tool or other structural uses.

The liquid phase sintering referred to herein is that thermal process for agglomerating or alloying a mixture of powdered metals where one but not all the phases (the constituent metals) liquify during the sintering or heating.

The metals mixture advantageously is formulated to flowable liquid form by incorporation with a liquid vehicle having a suitable suspension agent dissolved therein for holding the metals suspended in the solution as a slip and the filaments and/or strands coated therewith preparatory to heating. The filaments may be assembled together in the small groups before, during or after coating. Upon coating they may be beneficially partially dried in air. The coated filaments are preheated in a non-oxidizing protective environment and then liquid phase sintered for short periods and then cooled to alloy the metals mix solidly about the filaments. The method combines the filaments and matrix into the referred to unitary preforms which then can be conveniently handled prior to or during production of larger articles therefrom. If the filaments are initially chopped to desired lengths, e.g., short lengths, there result individual nuggets containing a relatively high volume of the filaments in the alloy matrix. The finished solid nuggets or preforms are adapted to be coated with the same metals mixture, and in some cases air dried. The coated nuggets may then be assembled, preheated and liquid-phase-sintered (modified brazing) together according to the method herein to alloy the coating which bonds the preforms together to form the larger finished articles. Where long strands of the filaments, e.g., a tow, are coated and assembled, the procedure is the same except that the filament-containing metal tape resulting from the initial alloying can be worked into other shapes or sheared or cut to desired lengths of filament bundles prior to assembly together which pregrouping provides a convenient way to handle and collocate a large volume of the filaments into the final form desired.

An important object of the invention is to provide material and process for assembling high strength matrix/filament composites.

Another object of the invention is to provide a process for convenient assembling of high hardness filaments to make filament/matrix composite structures and tools.

Yet another object provides for fabricating composite structures and tools to have localized zones containing a relatively high volume percentage of the filaments for improved tensile strength or hardness as may be desired.

Yet another object of the invention is to provide method and material for making chopped lengths of boron/metal matrix bundles for use as substitutes for diamonds in applications such as drills or other tools.

A further object of the invention is to provide methods for effecting time savings and costs of fabrication of filamentary composite structures or tools by pre-grouping the filaments into a concentrated bundle which may be conveniently handled and collocated together with other like bundles.

A yet further object of the invention is to preassemble groups or bundles of the filaments secured in a metal matrix whereby further handling reduces the safety hazards attendant to handling of the individual tiny filaments.

BRIEF DESCRIPTION OF THE DRAWINGS

The above and further features, advantages and objects of the invention will become more apparent to those skilled in the art upon consideration of the foregoing together with the following examples and description, claims and the appended drawings hereto, and in which:

DESCRIPTION OF THE PREFERRED EMBODIMENTS

Figure 1:
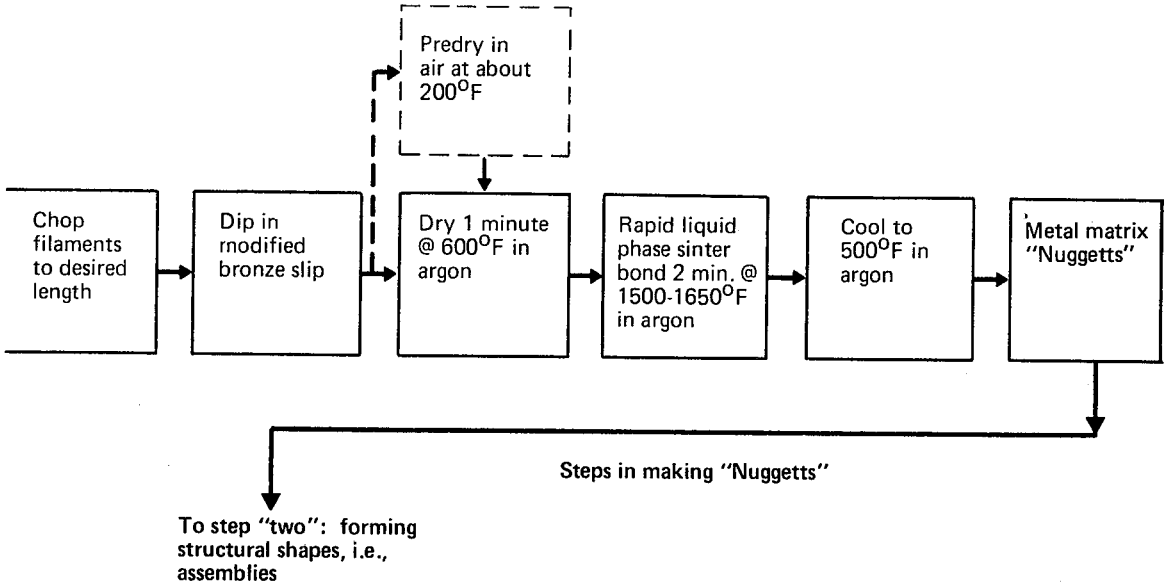
FIG. 1 is a process flow diagram showing steps in making nuggets or bundles of filaments precut to length and joining the nuggets into final articles.

According to a preferred method of making the modified bronze alloy of this invention and preforms containing the alloy solidified about groups of boron filaments, the filaments are provided in the desired lengths. The boron filaments are characterized by super high hardness making them suitable for cutting the hardest known materials except diamond. The filaments may be initially short filaments or may be taken from a spool or other supply and chopped to the desired short lengths as indicated by FIG. 1. Preferably, however, because of ease in handling with reduced hazard and speed of production the filaments are provided from spools as effectively or substantially continuous long lengths as in FIG. 2 where they are grouped together as long strands or tows. The filaments in the desired lengths are coated with the herein described metals mixture formulated into a liquidized metals-containing slip and which has been found to nicely adhere to the filaments preparatory to stacking or otherwise collocating them in the desired preform shape.

The coated filaments are collocated together into fascicles or groups each containing a plurality of the filaments aggregated or collected closely together. They may be placed so as to appear in any desired arrangement, e.g., sheaves or bundles, in the individual completed preforms or bundle units. For cutting and abrading, the coated filaments are arranged side by side generally axially parallel such as in cartridge-like or nugget shapes to present an end on array of filament ends against a workpiece surface to be cut, for example, by use of short filament lengths. Side by side laying or drawing together of the filaments as tapes or ribbons of filaments is accomplished in the case of using the longer filament lengths which tape preforms are useful in making structural shapes or in continuous linear production of shorter nuggets therefrom. When short filaments are used it is advantageous to preliminarily air dry the coated filaments, desirably in air heated to about 200° F. This effects some drying to partially remove or drive off the liquid vehicle of the solution, which may be water, alcohol or other vehicle, and facilitates handling of the short filament lengths.

The wet or partially dried groups of coated filaments are placed in a non-oxidizing protective environment and preheated to remove or further remove the liquid or liquid vehicle and break down and/or at least partially remove the material of the suspension agent by volatilizing which purifies the coating for further treatment, i.e., alloying and adherence to the filament or a substrate. Following preheating the coated boron filament groups are subjected to liquid phase sintering in a non-oxidizing protective environment to alloy the metals of the mixture about the filaments which are then cooled in a like protective environment followed by cooling to room temperature. The resulting individual preform units can each contain a relatively high volume (up to about 50% by volume) of the filaments and provide for the desired convenient and automated handling of large numbers of the filaments in making other structures from the preforms.

Nugget-like groups of the boron filaments bonded in the alloy metal matrix were prepared using both short filaments cut to length and long strands of the filaments to produce the referred to metal tapes. The latter may be subsequently chopped to desired shorter lengths. (See FIGS. 1 and 2.)

Use of the short lengths of boron filaments is exemplary. These were dipped in a metals containing or modified bronze slip prepared from a mixture of metallic or substantially elemental metals in powdered form consisting essentially of copper in an amount of about 68%, tin in an amount of about 25%, and titanium in an amount of about 7%, all by weight of the mixture. The mixture was formulated into a metals-containing liquidized suspension or slip of the metals by adding the mixture to a solution of about ½% to about 1% in water of a hydro-colloid as a suspension agent for the metals. A sodium salt of alginic acid was found to give excellent results when used for the suspension agent. This salt is available commercially under the name "Keltex", a trademark of the Kelco Company, San Diego, Calif. A formulation of about 4 parts of the metals mixture added to about 1 part of the solution has been found to provide an excellent slip to coat the filaments with the metals. The wet, coated filaments were then grouped or bundled together, e.g., by stacking or laying them side by side in substantially parallel collimation by placement into a cavity or trough preparatory to drying, heating and the referred to sintering. The short filaments can be coated by placing in a hopper containing the slip and extruding the filaments through an orifice to at once coat and align them in parallel.

The long filament lengths or strands are passed through an orifice in a container of the formulation or slip as a means of bundling them while coating. In this case the coated filaments in the groups or bundles were passed directly into a preheat zone or furnace chamber containing a non-oxidizing protective argon gas environment or atmosphere and there preheated for about 1 minute at about 600° F. for substantially complete drying of the liquidizing vehicle from the coating and to at least partially break down or remove the suspension agent thereby purifying the coating or slip. Following preheating the bundles were subjected to liquid phase sintering in a non-oxidizing protective atmosphere within a furnace chamber for about 2 minutes at from about 1500° F. to about 1650° F. in which range satisfactory results are obtainable. The preheating step preceding has been found to shorten the time required for the liquid phase sintering. A liquid phase sintering temperature of about 1600° F. is preferred in that it has been found to yield excellent results. The bundles were thereafter cooled in a cooling zone or chamber containing a non-oxidizing protective environment to about 500° F. which completes the alloying of the metals of the mixture into the desired matrix which strongly secures the filaments together supported therein. The filaments are found to be substantially undegraded, i.e., their desirable cutting and abrading properties are retained. Cooling to room temperature may then be accomplished. Beneficially final cooling may be conducted in a non-oxidizing protective environment but the satisfactory results are produced if conducted in air. Nuggets or preforms made in accordance with the above-described method were found to perform well in cutting or abrading of various materials including boron fiber-containing composite materials. Surprisingly, the resulting metal alloy has been found, in the combination as processed herein, to have enhanced strength and toughness beyond that expected from the individual metals alone or otherwise combined. The alloy has a melting temperature above that of the tin phase which provides for constructing larger assemblies from a plurality or aggregation of the completed preform bundles by coating them with the same mixture and heating to substantially remove the liquid and suspension agent impurities and then liquid phase sintering as in the making of the original preforms.

Argon gas has been found to be a highly beneficial non-oxidizing protective environment for any of the foregoing steps requiring the same. A high degree of vacuum or other suitable protective environment may also be used as will be understood.

The preparation of long bundle lengths of tape-like preforms is treated generally the same (e.g., coat, bundle, heat to dry and purify, rapid liquid phase sinter bond and cool except the setup is in one continuous line during which different portions of the bundled filaments may simultaneously undergo differing ones of the aforesaid method steps. The coating and bundling step is accomplished by passing a series of separated filaments into a chamber filled with the above described metal slip and out of the chamber through a single orifice into the treatment chambers. The preheating, liquid phase sintering and cooling may thus be simultaneously done by continuously passing the long bundle or tow through a series of chambers or zones each filled with a non-oxidizing protective atmosphere or environment such as argon. Advantageously the gas is passed in counterflow movement to the direction of travel of the bundle to sweep away the impurities and avoid formulation of ash in the matrix. Thus zones are provided for each of the foregoing steps, e.g., preheat, sinter, and cool with the bundle exiting from the final zone in completed form. If "nuggets" are desired from the continuous tape it is then only necessary to shear or diamond saw the tape into the desired lengths. The boron has little ductility and can be effectively sheared. With the preparation of the "nuggets" or the tape, the desired composite shape can then be fabricated by simply assembling a series of the "nuggets" side by side, coated as above, into a structural configuration and applying a second and final thermal cycle. The assembly of the "nuggets" can be done by hot pressing powder metallurgy, by diffusion bonding, or the rapid liquid phase sintering. The basic "nugget" shape makes most routine assembly methods easy to accomplish resulting in a high volume percent filament composite. Similarly, using unchopped lengths of tape, structural shapes can be made by winding the coated metal tape or preform on suitable forms or they may be shaped or wound followed by coating, then processed through the thermal cycle.

The metals mixture combined and processed as herein, has been found to provide excellent "wetting" of the filaments with resulting good "sheeting" action in coating and adhereing to and about the filaments during the heating cycle. Also, the alloy and process provide an excellent vehicle by which substantially axially parallelized alignment of the filaments properly spaced apart randomly in the matrix can be made. The fiber groups may thus be economically solidified into a variety of sizes of preforms and finished shapes assembled therefrom. The invention also provides for large surface arrays of filament tip ends directed outward for cutting use and for lengthy shapeable preforms for structural use. The alloy has been found to wear away, when used with the filaments for cutting, at a slow rate and to nicely support the filaments thereby achieving long term cutting action from them with a minimum of filament attrition.

Boron filaments from about 0.004 inches diameter to about 0.008 inches diameter have been found to produce good preforms. Spacing between such filaments is variable with about 0.003 inches to about 0.008 inches producing good preforms and final cutting materials or structural shapes.

Figure 2:
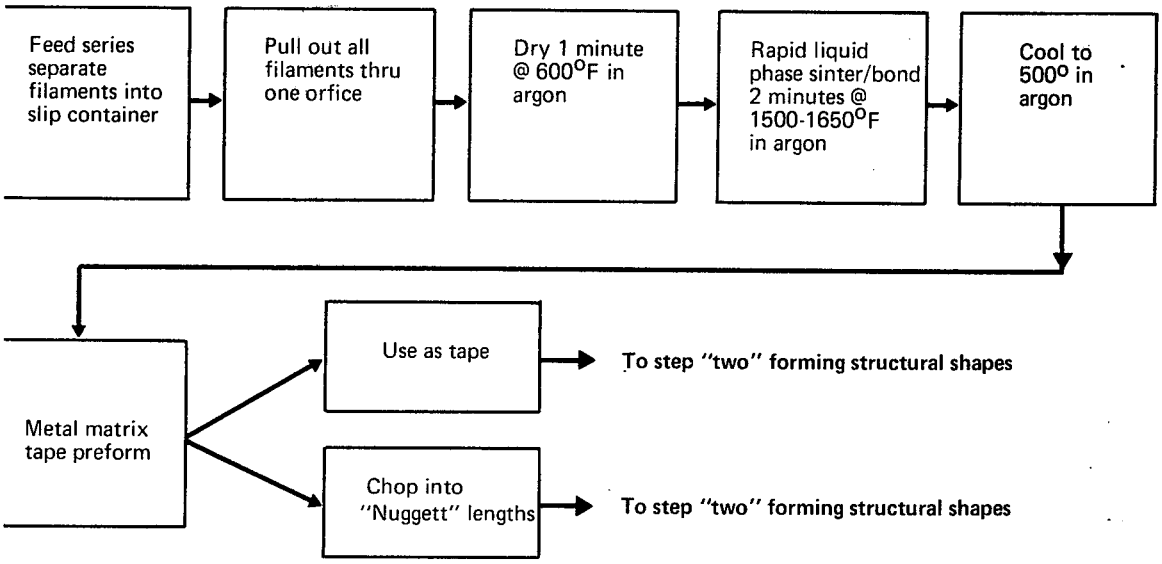
FIG. 2 is a process flow diagram showing steps in continuously making pregrouped or bundled filaments from long lengths into metal tape preforms which can be used to form structural shapes or be chopped into nugget lengths and a plurality of either type preform subsequently coated and bonded together.

It will be appreciated that when short nuggets or other preforms are made by either the process of FIG. 1 or FIG. 2 they are subsequently easily handled mechanically, e.g., by automatic equipment to coat them with the metals mixture and stack or lay them side by side and then effect the heating and mechanically assembled liquid phase sintering heat cycle and cooling as heretofore described to bond or braze the assembled units together into the desired larger or finished structures. Where metal tape is formed as by the process illustrated in FIG. 2 the preforms in the form of tapes cut to various lengths can be bent and worked, e.g., by winding into various curvatures and shapes, or placed together by mechanical means, and subjected to the coating, preheating and modified brazing or liquid phase sintering followed by cooling to assemble larger structures. The processes substantially reduce the indicated problems of the prior art.

In the case of nuggets, for example, made and bonded together as indicated above into a large tool assembly of the smaller nuggets, a rotary cutting or drilling tool for cutting and abrading properties of the boron filaments which were well supported in the alloy. In making the tool preforms of filament bundles axially therein were coated with the metals mixture of the invention applied by the aforesaid slip. The coated preforms were axially arranged around inner and outer cylindrical surfaces of the end of a cylindrical or tubular steel substrate and preheated to 600° F. and liquid phase sintered to about 1600° F. and cooled to 500° F. as set forth above. The completed core drill tool resulting therefrom was found highly effective in drilling boron containing composite materials.

Various modifications will occur to those skilled in the art.

What is claimed is:

1. A liquid phase sintered alloy for bonding together or to a substrate a plurality of high hardness boron filaments so as to hold the filaments in a solid, tough, metals matrix which supports and maintains the integrity of the filaments which comprises:

an alloy of a mixture of metals consisting essentially of copper in an amount of about 68%, tin in an amount of about 25%, and titanium in an amount of about 7%, all by weight of the alloy;

said alloy being produced from a slip containing about 4 parts of said metals mixture, the metals being in powdered substantially elemental form, and about 1 part of about a ½% to about 1% liquid solution of a hydrocolloid suspension agent by preheating said slip in a non-oxidizing protective atmosphere at about 1 minute at about 600° F. to purify the slip by removing the liquid and the suspension agent therefrom;

liquid phase sintering said purified slip for about 2 minutes in a non-oxidizing protective atmosphere at from about 1500° F. to 1650° F.; and cooling said liquid phase sintered purified slip in a non-oxidizing protective atmosphere.

2. A composition of matter for forming a tool structure containing intact high hardness boron filaments in a tough, liquid phase sintered alloy metal matrix and adaptable for cutting high hardness materials which comprises:

a plurality of high hardness boron filaments positioned side by side in an alloy metal matrix;

said alloy being produced from a mixture of metals consisting essentially of copper in an amount of about 68%, tin in an amount of about 25%, titanium in an amount of about 7%, all by weight of the alloy and produced from a slip formulated as about 4 parts of said metals mixture, the metals of said mixture being in powdered substantially elemental form and blended with about 1 part of about a ½% to about 1% liquid solution of a hydrocolloid suspension agent:

the metals mixture being applied the filaments by coating them with said slip followed by preheating said slip coated filaments in a non-oxidizing protective atmosphere at about 1 minute at about 600° F. to purify the slip by removing the liquid and the suspension agent therefrom;

liquid phase sintering said preheated coated filaments for about 2 minutes in a non-oxidizing protective atmosphere at from about 1500° F. to 1650° F.; and cooling said lquid phase sintered coated filaments in a non-oxidizing protective atmosphere;

whereby said copper and titanium remain substantially unliquified during the sintering to produce a tough alloy metal matrix in which the filaments are retained substantially intact.

* * * * *